US006722292B2

(12) United States Patent
Salmanson et al.

(10) Patent No.: US 6,722,292 B2
(45) **Date of Patent: *Apr. 20, 2004**

(54) MODULAR LOW COST PALLET AND SHELF ASSEMBLY

(75) Inventors: Jeffrey Salmanson, Woodland Hills, CA (US); Jon R. Dickey, Covina, CA (US)

(73) Assignee: E-Z Shipper Racks, LLC, Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/388,860

(22) Filed: Mar. 14, 2003

(65) Prior Publication Data

US 2003/0159627 A1 Aug. 28, 2003

Related U.S. Application Data

(63) Continuation of application No. 09/829,589, filed on Apr. 9, 2001, now Pat. No. 6,609,466, which is a continuation of application No. 09/358,285, filed on Jul. 21, 1999, now Pat. No. 6,244,194, which is a continuation of application No. 09/081,411, filed on May 19, 1998, now Pat. No. 5,979,338.

(60) Provisional application No. 60/046,883, filed on May 23, 1997, and provisional application No. 60/062,754, filed on Oct. 23, 1997.

(51) Int. Cl.[7] ..... B65D 19/44

(52) U.S. Cl. ..... 108/55.1; 108/107

(58) Field of Search ..... 108/55.1, 107, 108/51.11, 53.11, 106, 180

(56) References Cited

U.S. PATENT DOCUMENTS

| | | | | | |
|---|---|---|---|---|---|
| 2,935,210 | A | * | 5/1960 | Cohen | 108/64 |
| 3,273,720 | A | * | 9/1966 | Seiz | 211/192 |
| 3,294,250 | A | * | 12/1966 | Evans | 211/190 |
| 3,672,515 | A | * | 6/1972 | Rous | 211/191 |
| RE28,244 | E | * | 11/1974 | Evans | 108/157.13 |
| 4,079,678 | A | * | 3/1978 | Champagne | 108/110 |
| 4,302,023 | A | * | 11/1981 | Kiesz | 280/43.24 |
| 4,344,368 | A | * | 8/1982 | Remington et al. | 108/57.15 |
| 5,979,338 | A | * | 11/1999 | Salmanson et al. | 108/55.1 |
| 6,244,194 | B1 | * | 6/2001 | Salmanson et al. | 108/55.1 |

FOREIGN PATENT DOCUMENTS

DE 19805445 * 8/1999

OTHER PUBLICATIONS

Rapid Rack Industries, Inc., Rapid Rack Catalog, 1990.

* cited by examiner

*Primary Examiner*—Jose V. Chen
(74) *Attorney, Agent, or Firm*—Gates & Cooper LLP

(57) ABSTRACT

A modular, low cost pallet and shelf assembly and a method for assembling the assembly is disclosed. The shelf assembly comprises a plurality of support members arranged so as to releasably accept a pallet therebetween, each vertical support member comprising a plurality of apertures disposed therethrough, wherein each aperture is configured so as to accept and releasably hold tabs inserted through the aperture, and a plurality of pallet securing members, each pallet securing member comprising at least one pallet securing member tab releasably securable within a vertical support member aperture and a securing surface for restraining the pallet between the vertical support members.

24 Claims, 17 Drawing Sheets

MODULAR LOW COST PALLET AND SHELF ASSEMBLY

CROSS-REFERENCE TO RELATED APPLICATIONS

"This application is a continuation of U.S. patent application Ser. No. 09/829,589, filed Apr. 9, 2001, for "MODULAR LOW COST PALLET AND SHELF ASSEMBLY," by Jeffrey Salmanson and Jon R. Dickey now issued as U.S. Pat. No. 6,609,466, which is a continuation of U.S. patent application Ser. No. 09/358,285, filed Jul. 21, 1999, for "MODULAR LOW COST PALLET AND SHELF ASSEMBLY," by Jeffrey Salmanson and Jon R. Dickey, now issued as U.S. Pat. No. 6,244,194, which is a continuation of application Ser. No. 09/081,411, filed May 19, 1998, for "MODULAR LOW COST PALLET AND SHELF ASSEMBLY," by Jeffrey Salmanson and Jon R. Dickey, now U.S. Pat. No. 5,979,338, issued Nov. 9, 1999, which claim benefit of U.S. Provisional Application No. 60/046,883, filed May 23, 1997 by Jeffrey Salmanson and Jon R. Dickey, and entitled "MODULAR PALLET AND SHELF ASSEMBLY USING CONVENTIONAL HARDWARE," and U.S. Provisional Application No. 60/062,754, filed Oct. 23, 1997 by Jeffrey Salmanson and Jon R. Dickey, and entitled "MODULAR LOW COST SHELF ASSEMBLY," all of which applications are hereby incorporated by reference herein.

BACKGROUND OF THE INVENTION

1. Field of Invention

The present invention relates generally to shipping and retail display devices and more particularly to a modular low cost pallet and shelf assembly using conventional hardware.

2. Description of Related Art

Products shipped from the manufacturer or producer are often shipped to the retailers in corrugated boxes. Typically, these boxes are loaded onto wooden pallets, lifted with a forklift onto a shipping container, and unloaded into the container for transportation to the retail outlet. When the goods arrive at the retail outlet, the corrugated boxes are removed from the shipping container, loaded onto pallets, moved to the retail display location or storage using a forklift or similar device. The products are then removed from the corrugated boxes, and placed on retail display.

There are several problems associated with the aforementioned procedures. Unloading and loading the corrugated boxes is a labor-intensive procedure, often resulting in damage to the products and/or the corrugated boxes. It is also common for the products to be damaged when the corrugated boxes (which are typically stacked during storage and transportation) collapse.

Another problem with these procedures is that the corrugated boxes are not generally reusable, and must be broken down and disposed of by the retail outlets. Alternative wood racking systems, such as those employed in nurseries, do not solve this problem. These racking systems are also difficult to transport, require labor intensive procedures to unload transported products and display them at a retail level, and cannot be broken down easily at the retail outlet. These devices are also typically held together with nails, which further complicate their disassembly and storage, and make any return to the manufacturer generally unprofitable.

SUMMARY OF THE INVENTION

As the foregoing indicates, there is a need for efficient transportation of products from the manufacturer or producer to retail display. The present invention satisfies that need.

The present invention discloses a racking system using a modular pallet and shelving assembly. This racking system is easily constructed and broken down, and which uses conventional, standardized, and readily available hardware. The design of the present invention directs the weight of the rack to a metal structure advantageously placed in relation to the pallet. Even when used with a commonly available wooden pallet, this design is exceptionally strong, allowing the unit to be lifted and transported with a forklift or pallet jack. This system provides an efficient system for delivering material and products to the marketplace (or to warehouses for later retail sales) without damage. The present invention also allows material and products to be removed from trucks by forklift, and placed directly on retail display.

Because the present system also utilizes reusable metal shelving, it can be easily broken down. This allows the system to be reused on site, disposed of by selling the racking system as a complete package, or in its component parts, or simply returned to the shipper or manufacturer for re-use. Further, because the design of the present invention is both simple and strong, the system can be more space efficiently constructed to take advantage of the available truck container space.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is understood that other embodiments may be utilized and structural changes may be made without departing from the scope of the present invention.

Figure 1:
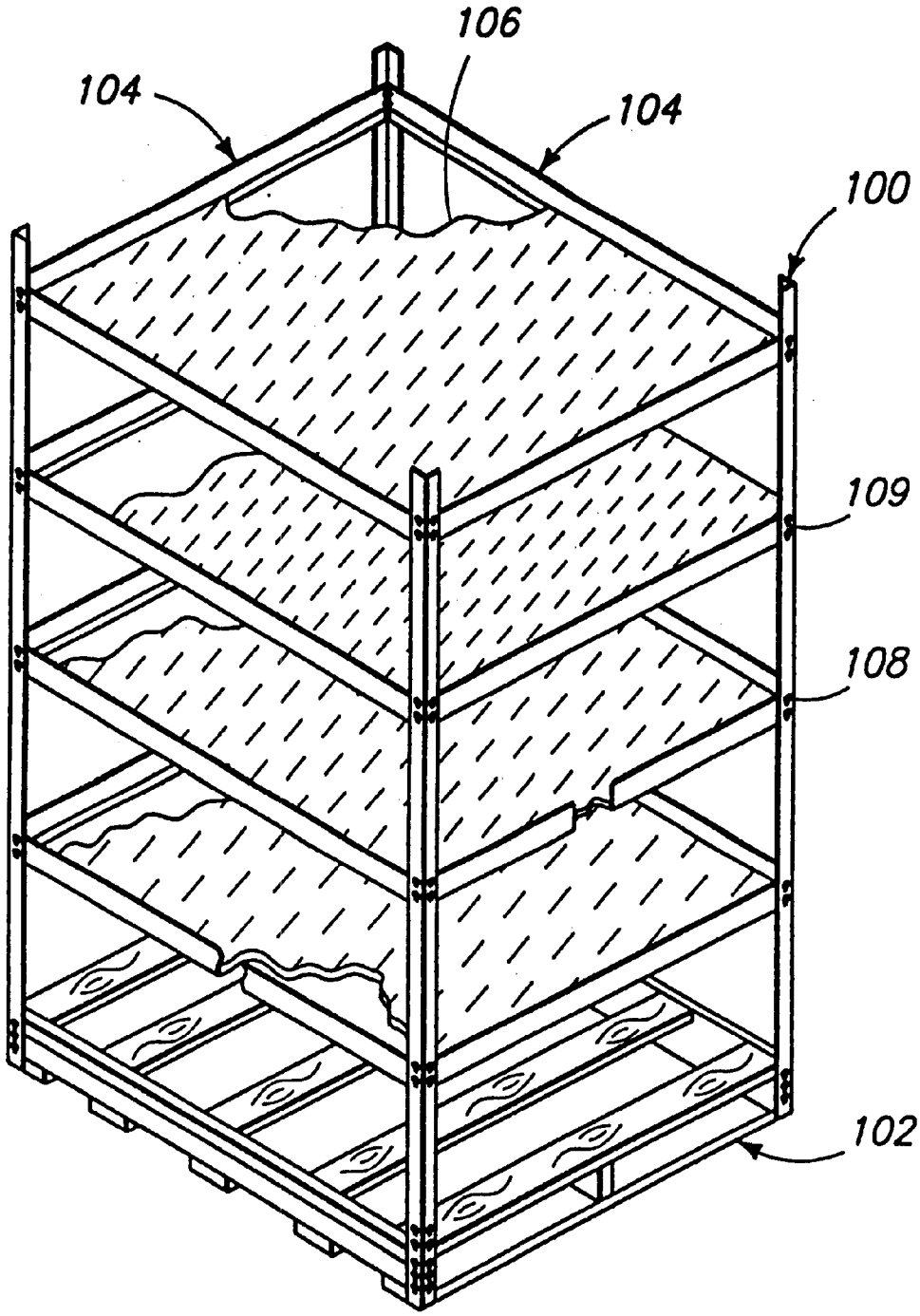
FIG. 1 is a perspective view of the one embodiment of the present invention.

FIG. 1 is a perspective view of one embodiment of the present invention. The invention comprises a plurality of L-shaped vertical support members 100, which are so arranged to accept a pallet 102 therebetween. In one embodiment, the pallet 102 is a common two-way wood pallet, which accepts forklift tongues in slots on the front and rear of the pallet 102. In an alternative embodiment, a four-way pallet may be used. The four-way pallet comprises additional slots on opposite sides of the pallet to accept forklift tongues, thus allowing the pallet to be lifted by a forklift from any side. The design of the pallet 102 can be changed to accommodate different loads, with heavier-duty construction pallets 102 employed for maximum strength applications. Each vertical support member 100 comprises a plurality of keyhole shaped apertures 108 disposed on the right angle portions of the vertical support members 100. In one embodiment, the vertical support members 100 are commonly available angle posts that are 84 inches in length.

The present invention also comprises a plurality of L-shaped cross braces 104, which are affixed to the vertical support members 100. Each L-shaped cross brace 104 comprises a right angle portion and a number of cross brace tabs 109, each of which is small enough to be inserted into the larger portion of the keyhole shaped aperture 108, yet large enough to be retained by the smaller portion of the keyhole shaped aperture 108. When a plurality of braces 104 are so coupled with the vertical cross members 100, the right angle portion (which comprises the lower portion of and "L" when viewed from the side) of the brace 104 forms a horizontal surface, upon which a planar surface 106 is placed. Planar surface 106 is sized so as to be inserted between all four vertical support members 100 and larger than the aperture formed by the braces 104 extending between the vertical support members. Accordingly, the braces 104 serve to support the planar surface 106. The planar surface 106 can be comprised of particle board, OSB, plastic, metal, or other material. Planar surface 106 may also be molded to conform to the product.

In one embodiment, the braces 104 are commonly available double rivet beams. The size of the braces 104 is selected in accordance with the desired dimensions of the finished assembly, as is the pallet 102 size. In a typical arrangement, two of the braces 104 are 48 inches in length, and two are 42 inches in length. The number of braces 104 used in the assembly is also determined by the number of desired shelves of the finished product. For example, a four-shelf unit would require eight 48 inch braces 104 and eight 42 inch braces, whereas a five-shelf unit wood require ten 48 inch braces and ten 42 inch braces.

Since four braces 104 are not required to hold the planar surfaces 106, it is also possible to use only two braces per shelf level, in a staggered relationship. For example, the first level can use two 48 inch braces 104, the next, two 42 inch braces 104, and so on. This configuration is nominally not as strong, but is lower in cost, and suitable for many applications.

Figure 2A:
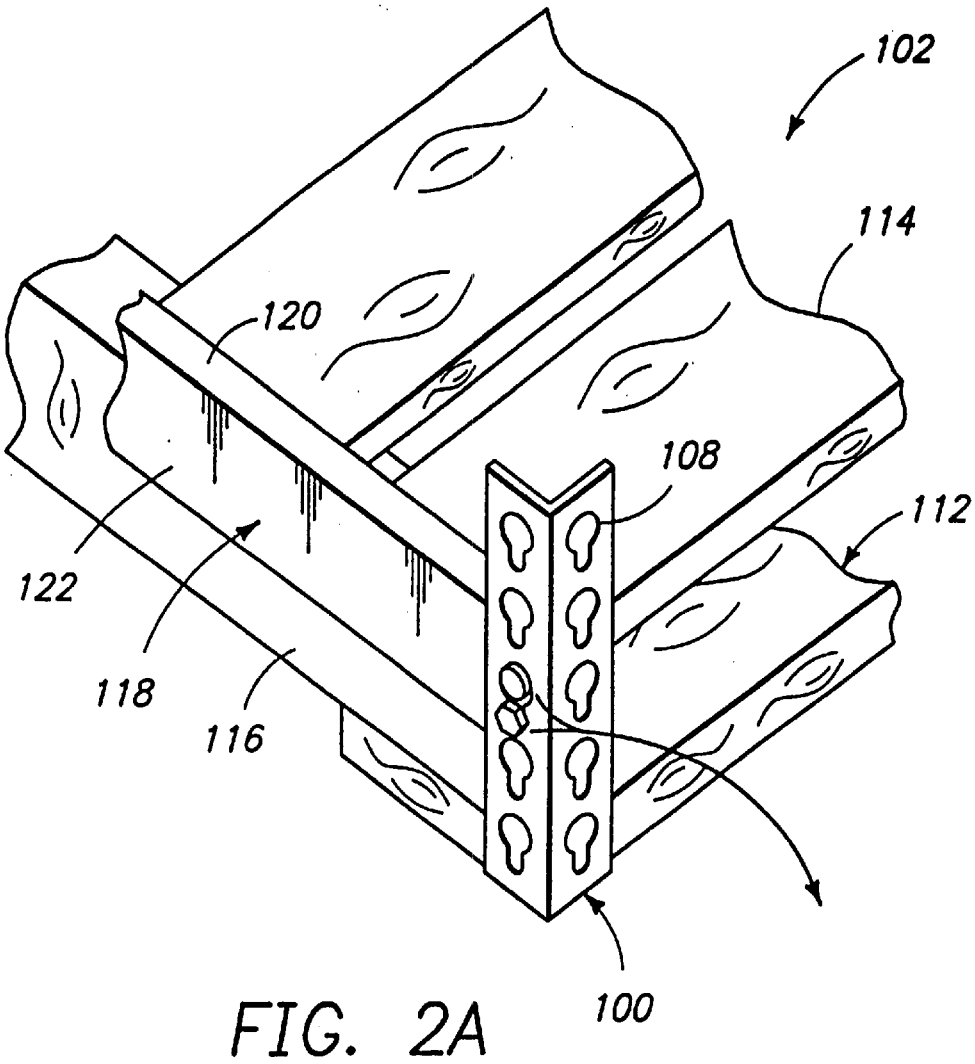
FIG. 2A is a view of one embodiment of the present invention, illustrating a coupling between the pallet and the shelving.

FIG. 2A is a close up view of one embodiment of the present invention, illustrating the relationship between the pallet 102 and the vertical support members 100. In this embodiment, pallet securing members 118 are utilized to releasably accept and secure the pallet 102 in place between the vertical support members 100, and to bear the weight of the racking system when lifted by a fork lift or pallet jack. As strength requires, either two or four pallet-securing members 118 can be used.

Figure 2B:
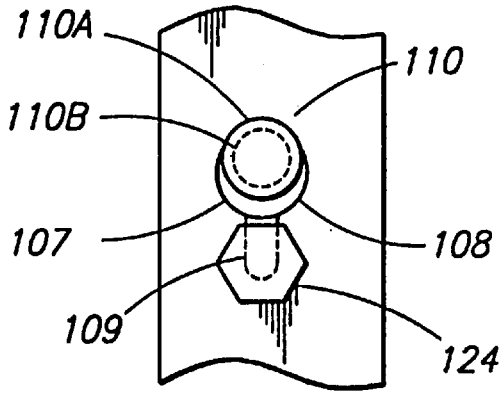
FIG. 2B is a close up view of the relationship between the tabs and the keyhole apertures in one embodiment of the present invention.

FIG. 2B is a detailed view of the embodiment shown in FIG. 2. Keyhole apertures 108 each comprise a first aperture segment 107 and a second aperture segment 109, which is smaller in cross section than the first aperture segment 107. Tab heads 110A are smaller than the first aperture segment 107, yet larger than the second aperture segment 109. Hence, when tab heads 110A are inserted into the first aperture segment 107 and moved laterally, the tab 110 is affixed within the aperture 108.

The pallet 102 comprises a plurality of bottom members 112 and support members 114, both of which are affixed to a pallet cross member 116. In one embodiment, the vertical support members 100 are affixed to the pallet 102 by inserting one or more wood screws 124 (such as lag screws) of suitable length and diametric cross section through the appropriate keyhole apertures 108 and into the pallet 102.

In another embodiment, a number of pallet-securing members 118 are employed. These pallet-securing members 118 comprise one or more pallet-securing member tabs 110 which are inserted into the keyhole apertures 108 of the vertical support members 100. Ordinarily, the pallet-securing member tabs 110 are of the same design as the cross member tabs 109. However, since the pallet-securing member tabs 110 must bear greater weight and shear force, these tabs may be suitably reinforced or made of stronger material, if necessary.

In one embodiment, the securing members 118 are cross braces 104, but inverted so that an interior-facing surface 120 is disposed above the vertical surface 122. This places an interior-facing securing surface 120 over the top of the pallet 102, and in particular, the pallet support members 114. In this configuration, the pallet 102 is restrained between the vertical support members 100. Pallet securing member tabs 110 on the support members 118 are inserted into the larger opening of the keyhole tabs 108. The support members 118 transfer the weight of the assembly to the metal structure, rather than the pallet 102.

The pallet support members 118 and vertical support members 100 may optionally be affixed to the pallet 102 with a suitably sized fastening device 124 such as a wood screw or lag bolt. The fastening device 124 should comprise a head larger than any dimension of the keyhole aperture 108. This assures that the components are securely fastened together. One-quarter inch lag bolts of 1-¼ inch length are suitable for this purpose. If necessary, a suitably placed hole or aperture may be drilled through the pallet 102 before the bolt is inserted and thereafter secured with a nut or other means.

The tabs 110 comprise a head portion 110A and a shank portion 110B. The head 110A is a smaller diameter than the larger portion of the keyhole apertures 108, to allow insertion therein. In one embodiment, the upper portion of the inner surface of the keyhole aperture 108 and the tab shank 110B are in contact, thus causing the tab head 110A to extend beyond the keyhole aperture 108. This provides additional strength to prevent the vertical support members 100 from extending away from the support brace 118. In another embodiment, the head size of the fastening device 124 is selected to be close to or contact the tab to minimize this possibility. In still another embodiment, the support brace 118 comprises two or more tabs 110, and each tab is inserted into its corresponding keyhole aperture 108. For additional strength, all of these couplings may be further secured by additional fastening devices 124, if desired.

Figure 3:
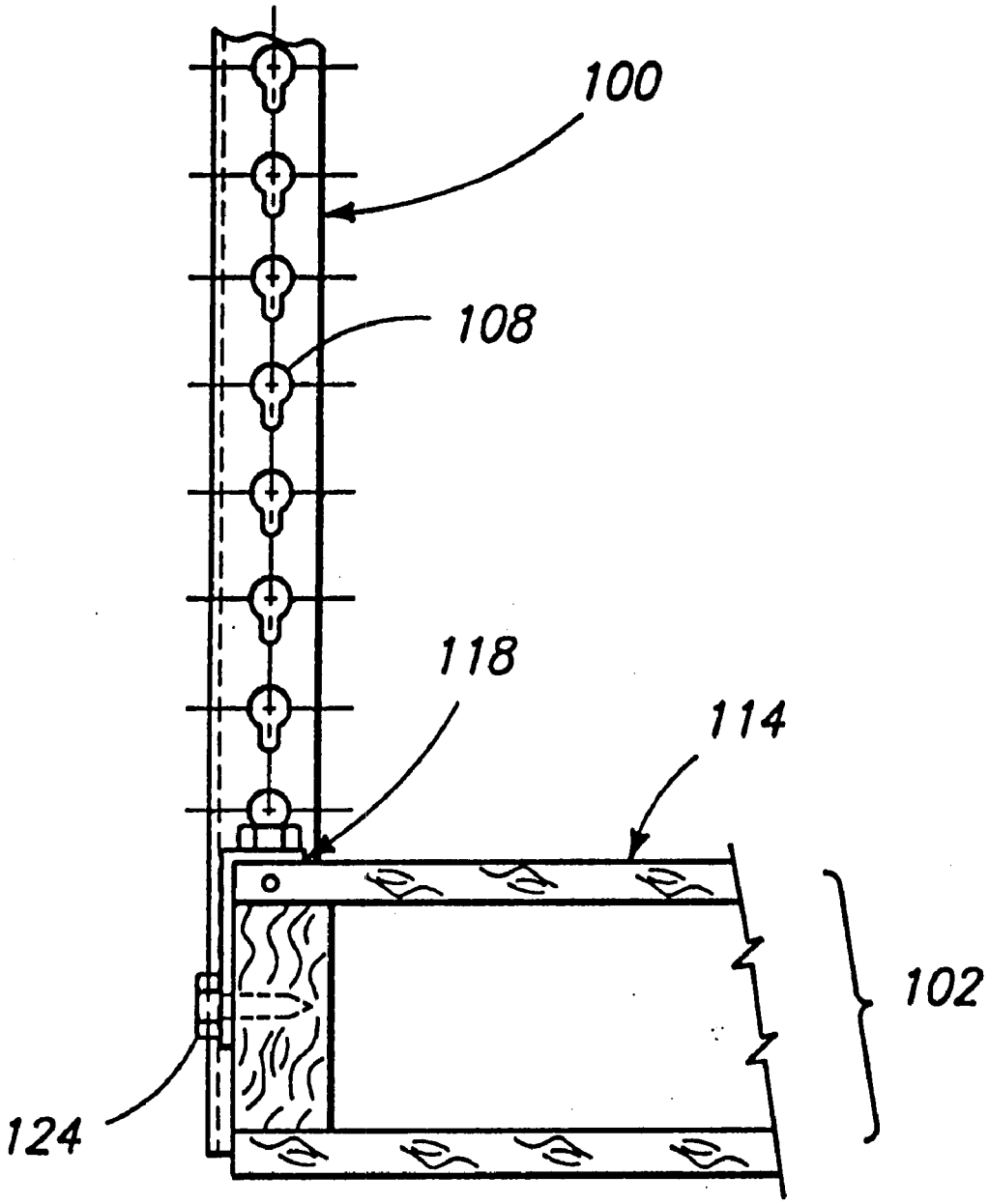
FIG. 3 is a side view of one embodiment of the present invention, illustrating the pallet and vertical support members.

FIG. 3 is a front view of one embodiment of the invention showing another view of the coupling between the pallet and vertical support members.

Figure 4:
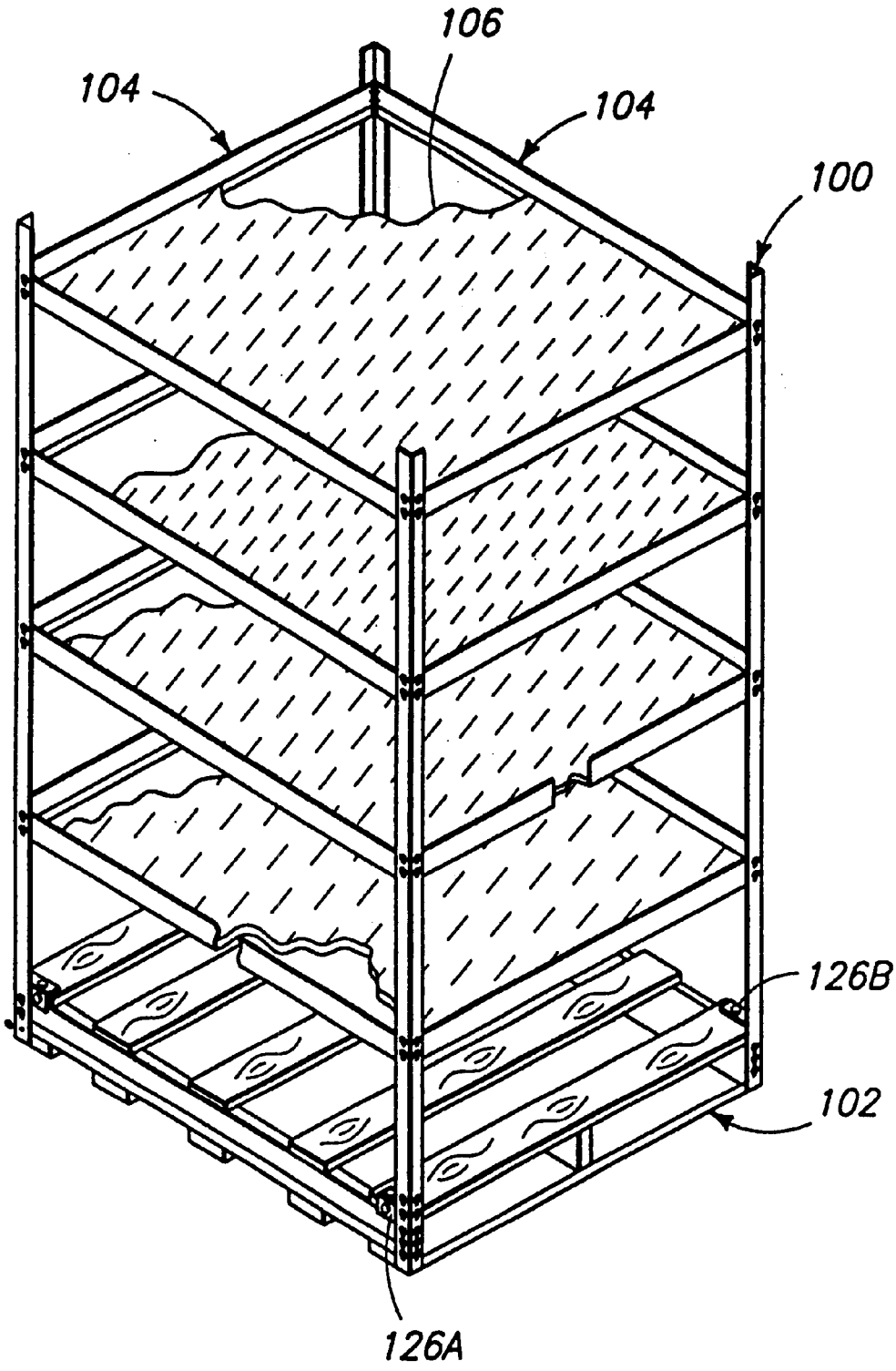
FIG. 4 is a perspective view of an embodiment of the present invention using cleats.

FIG. 4 presents another embodiment of the present invention, where pallet securing members 118 comprise one or more cleats 126, including a left cleat 126A and a right cleat 126B.

Figure 5:
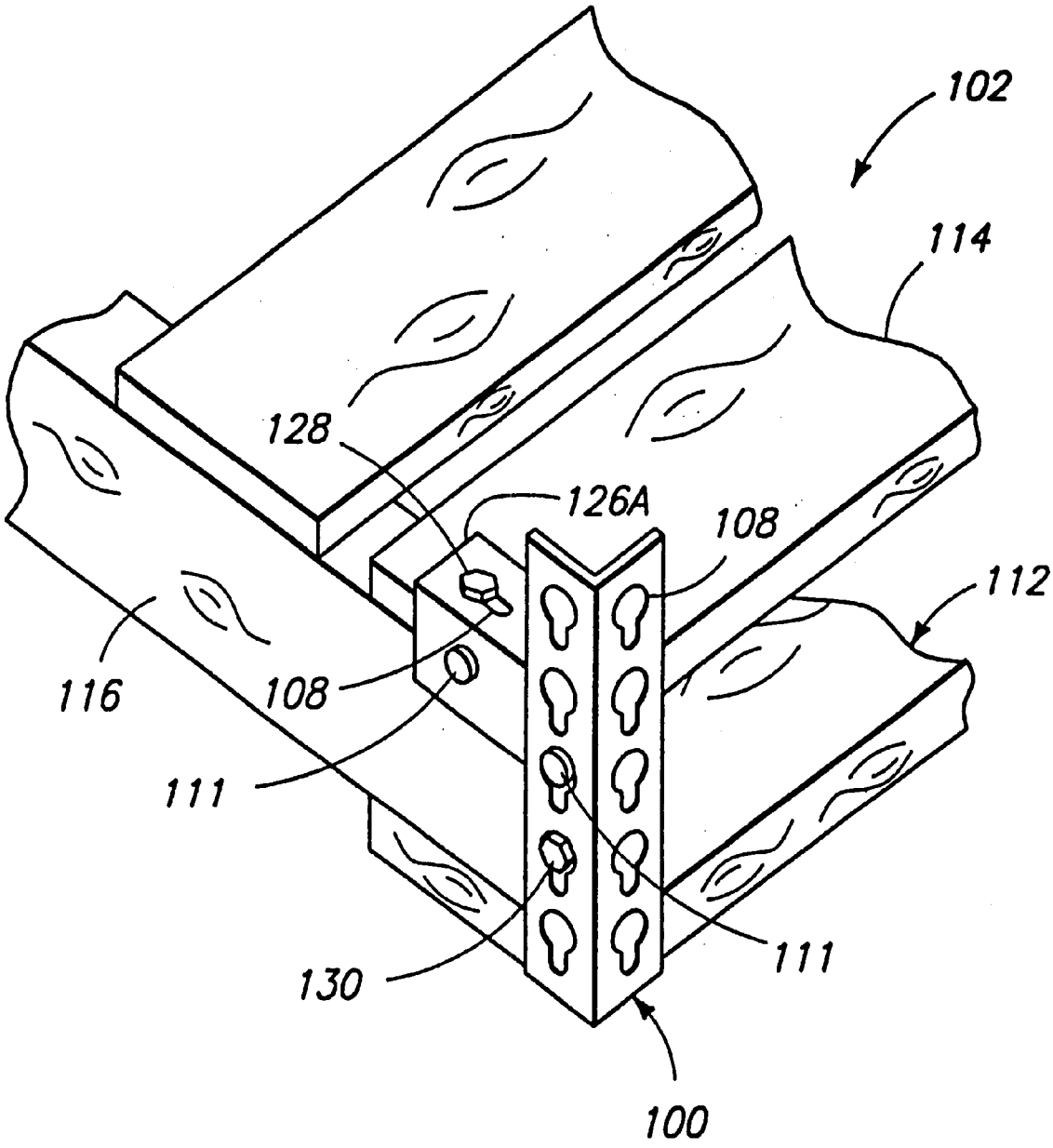
FIG. 5 is a close up view of one embodiment of the present invention, illustrating a coupling between the pallet and vertical support members.

FIG. 5 presents a close-up view of the employment of the cleats 126 in the present invention. Nominally, each cleat 126 is L-shaped, and comprises one or more cleat tabs 111 on one outer surface, and one or more keyhole-shaped apertures 108 on the other outer surface. In one embodiment, the cleat 126 is affixed to the pallet 102 by one or more fastening devices 128 inserted through the keyhole aperture 108 in the cleat. The fastening device 128 can be a wood screw of suitable dimension or other fastening means. Optionally, vertical support member 100 can be further secured to the pallet by one or more additional fastening devices 130. Cleat tab 111 extends within a keyhole aperture 108, and may be secured with an additional fastening device as described herein.

Figure 6:
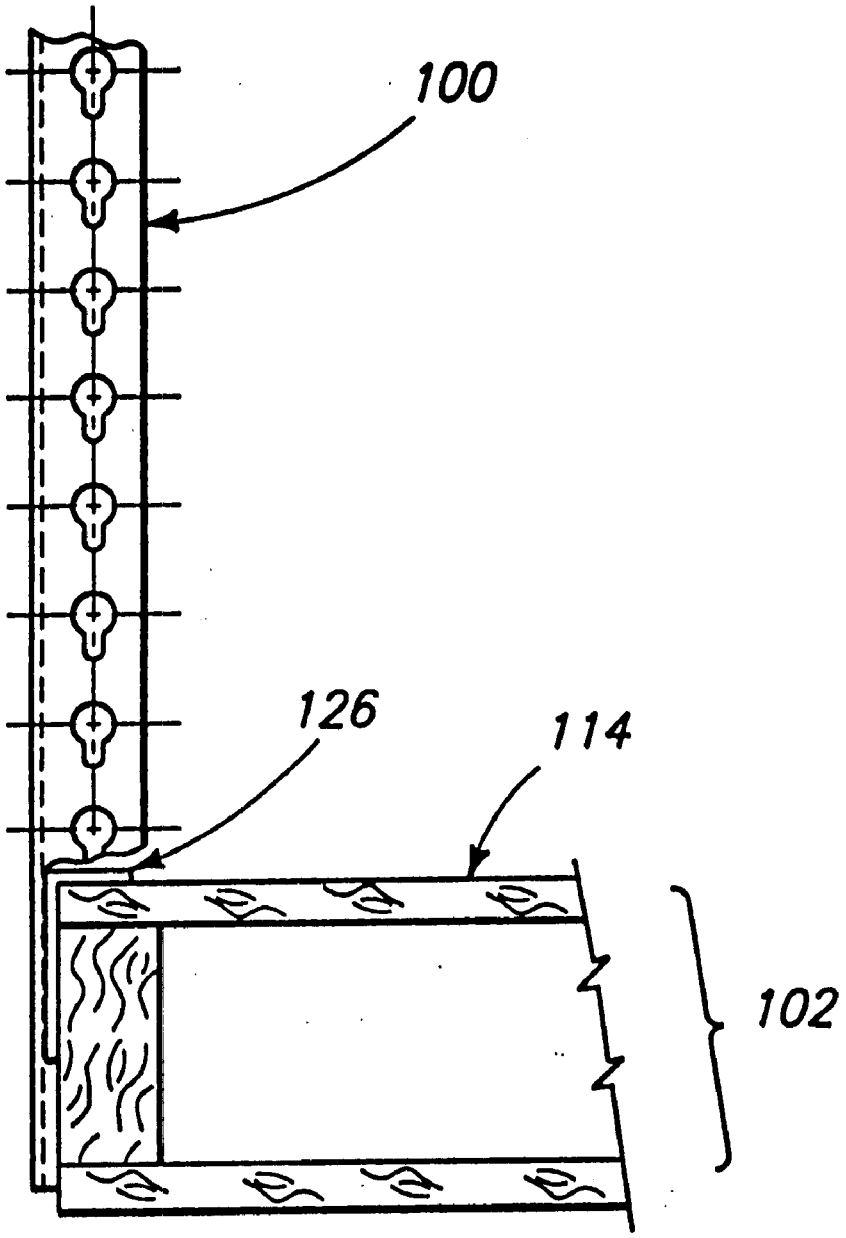
FIG. 6 is a side view of one embodiment of the present invention, illustrating the use of cleats to couple the pallet and the vertical support members.

FIG. 6 is a side view of the embodiment shown in FIGS. 4 and 5.

Figure 7:
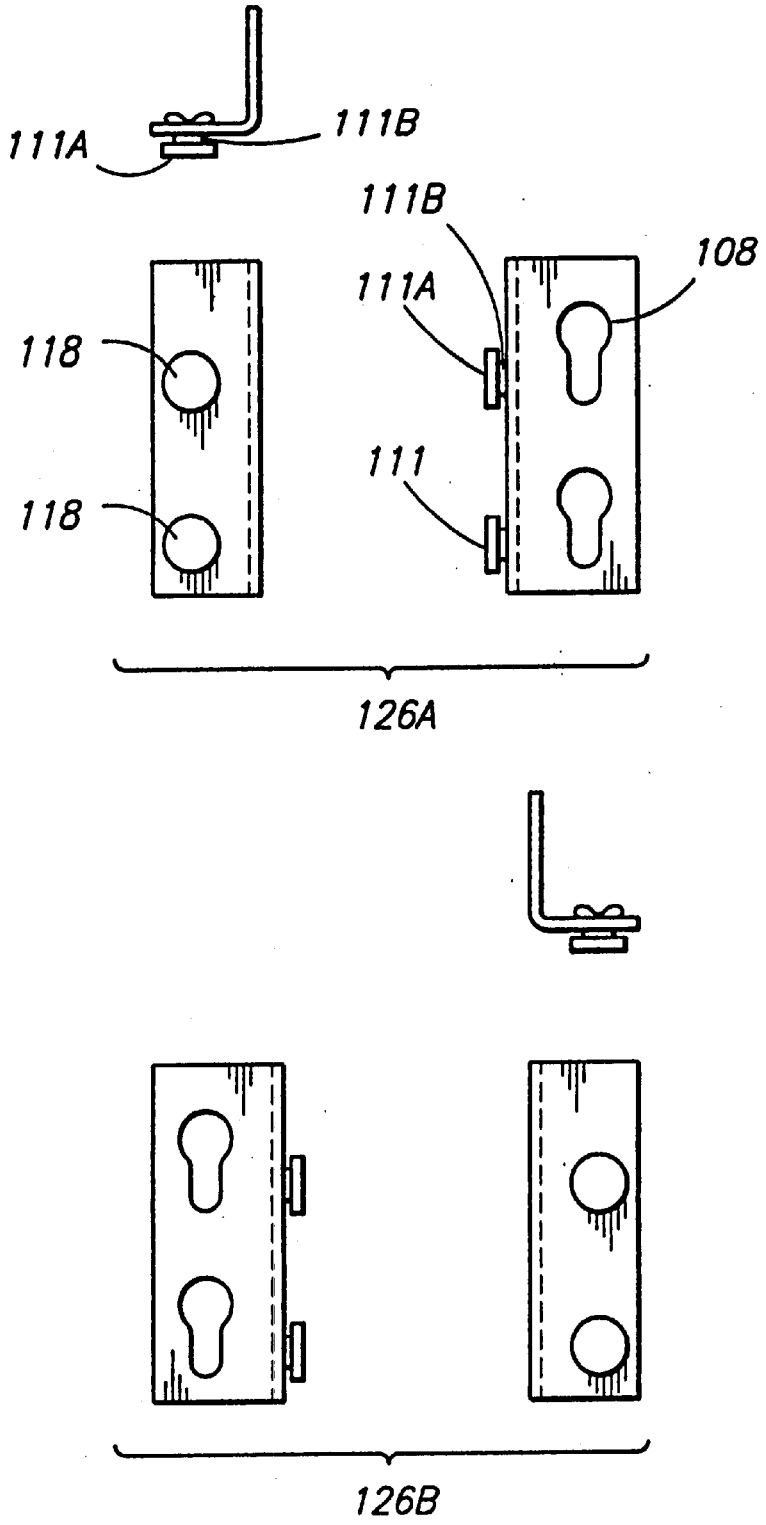
FIG. 7 is a diagram of the cleats used in one embodiment of the present invention.

FIG. 7 is an illustration showing the two types of cleats employed in the embodiments shown in FIGS. 4 and 5. Left cleats 126A (depicted in FIG. 5), and right cleats 126B are employed. Nominally, a total of four cleats 126 (two left cleats 126A, and two right cleats 126B) are used.

Nominally, four vertical support members 100 are employed in the present invention, one at each corner of the pallet 102. In alternative embodiments, the present invention can comprise additional vertical support members 100 for additional bracing. Nominally, these additional vertical support members 100 will be flat, and not L-shaped, so as to be easily affixed to the cross members 104, but the present invention can accommodate a wide variety of vertical support member shapes with modification. These additional vertical support members 100 may be affixed to the pallet, but need not be so. Further, if exceptional rigidity is required, the additional cross bracing may be employed in either the pallet 102 structure, the metal between vertical support members 100, or both.

Figure 8A:
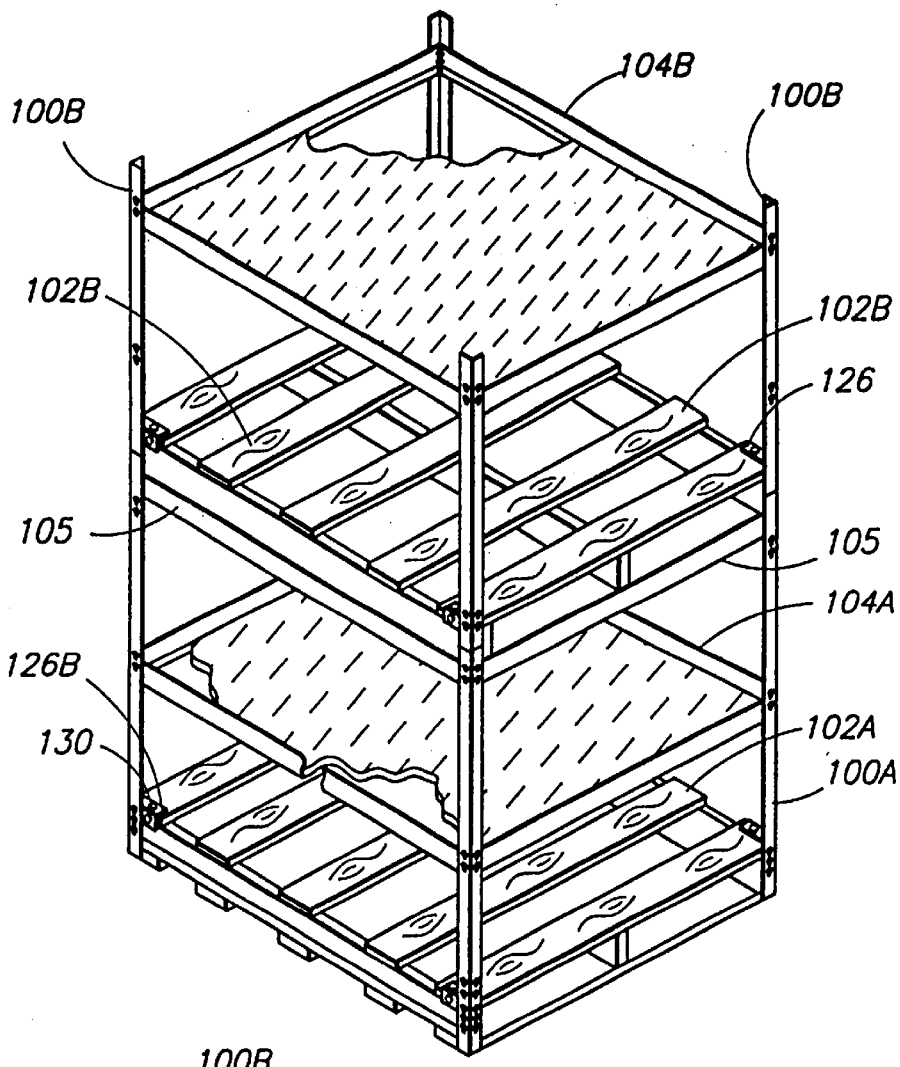
FIG. 8A is a perspective view of another embodiment of the present invention illustrating a segmented design suitable for smaller merchandising units.

FIG. 8A presents perspective view of another embodiment of the present invention illustrating a segmented design in which the assembly comprises two rigid, yet easily separable sections which can be separated to form smaller shelving units for separate transport or for display and merchandising of products. In this embodiment, the vertical support members 100 comprise bottom vertical support members 100A and top vertical support members 100B, both of which are of generally shorter length than the vertical support members 100 previously described herein. The lower portion of the bottom vertical support members 100A are secured to a first pallet 102A using the techniques and structures described earlier in this disclosure.

A plurality of cross braces 104 are coupled to the vertical support members 100. Cross braces 104A are coupled to the vertical support members 100 to form an aperture for inserting planar surfaces 106 a right angle shelf portion on which supports the planar surfaces 106, as previously described and illustrated. Pallet support members 105 are inserted between the lower vertical support members 100A at the topmost position in an inverted "L" configuration, with the right angle portion disposed above or below the vertical portion. So disposed, the right angle portions of the pallet support members 104B form a shelf or cavity which supports a second pallet 102B, which, if desired, may be secured to the assembly using lag screws 130 or similar fastening devices inserted through apertures in the right angle portions of the cross braces 104B. Upper vertical support members 100B and second pallet securing members such as the cleats 126 described earlier are then secured to the upper pallet 102B using the structures and methods previously described to secure the shelving to the pallet 102, using either cleats 126, pallet securing members 118, or inverted cross braces 104.

Figure 8B:
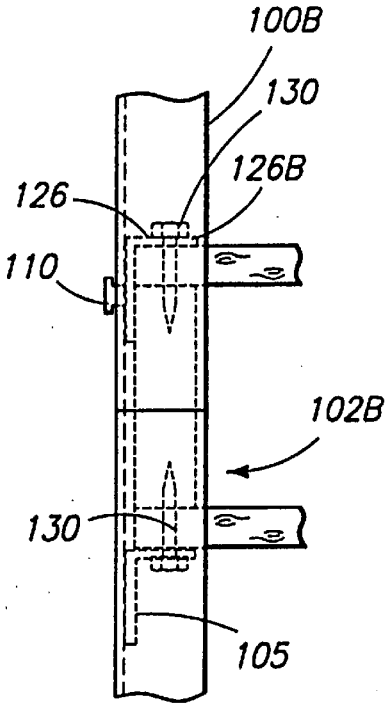
FIG. 8B is a section view of the coupling between the segments shown in FIG. 8A.

FIG. 8B is a side view of the structures shown in FIG. 8A.

Figures 9A, 9B:
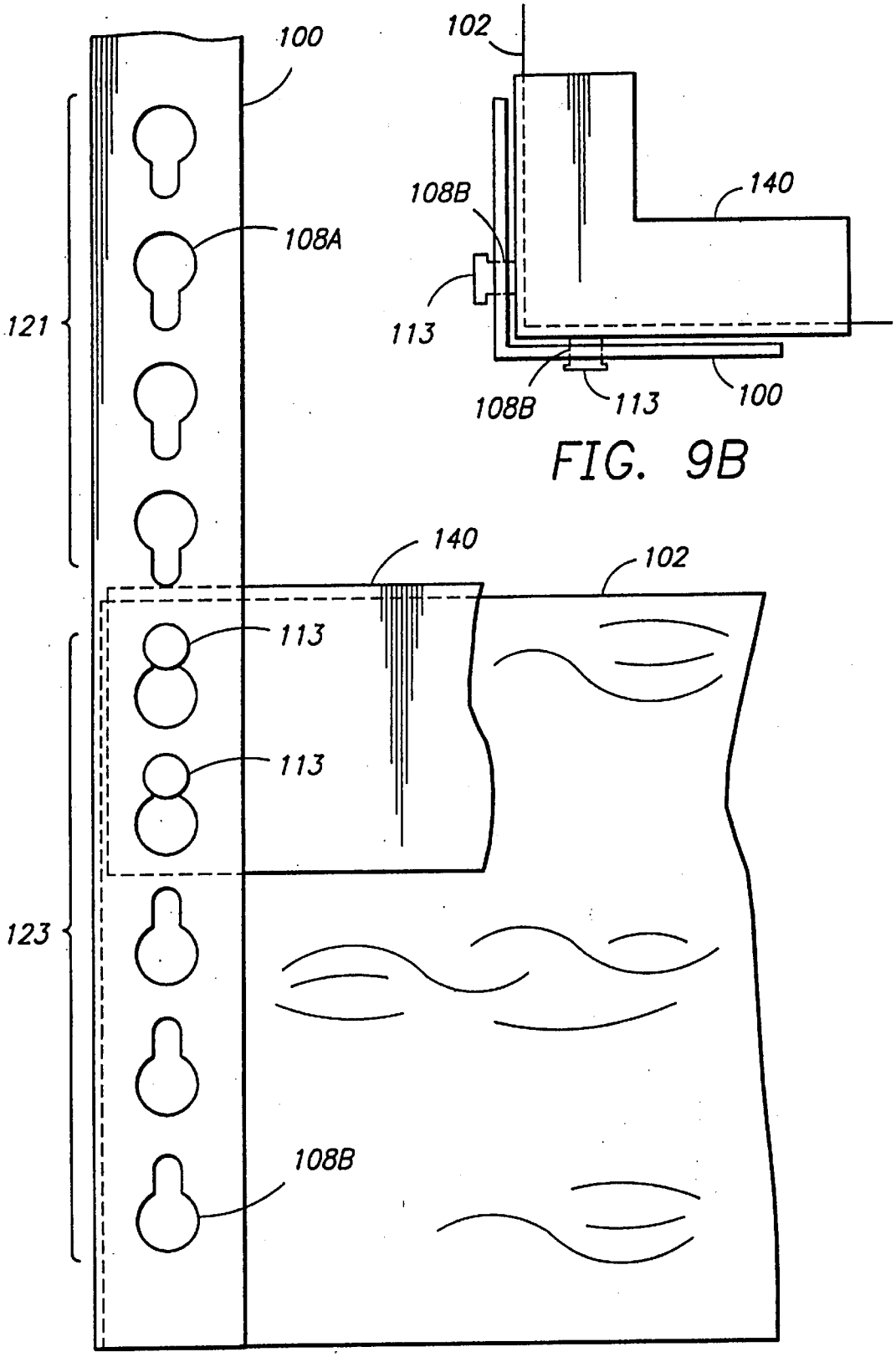
FIG. 9A presents a side view illustrating the use of an inverted keyhole aperture configuration.
FIG. 9B presents a top view illustrating the use of an inverted keyhole aperture configuration.

FIG. 9A presents a side view of another embodiment of the present invention illustrating the use of a unique keyhole aperture 108 configuration. In this embodiment, the vertical support member 100 comprises two sets of keyhole apertures 108, a first set 121 comprising one or more keyhole apertures 108A facing in a first direction, and a second set 123 comprising one or more keyhole apertures 108B facing in a second direction substantially inverted from that of the first set of keyhole apertures 108A. For purposes of clarity, keyhole apertures 108A will be referred to henceforth as downward facing keyhole apertures, and keyhole apertures 108B will be referred to as upward facing keyhole apertures. This embodiment also shows another alternative for the pallet securing members 118. Here, one or more right angle support members 140, having one or more right angle support member tabs 113 of suitable size for insertion into the upward facing keyhole apertures 108B are utilized. The right angle support members 140 are disposed adjacent to the vertical support members 100 in a fitting relationship and affixed to the vertical support members by inserting tabs 113 in the upward facing keyhole apertures 108B, and applying suitable force in a direction towards the upward facing keyhole aperture 108B smaller portion.

When the foregoing elements are arranged as described above, a pallet 102 can be inserted in the space formed by the vertical support members 100 to allow the entire assembly to be lifted and moved with a forklift or other similar device. Lifting forces from the pallet 102 are then borne by the right angle support members 140, right angle support member tabs 113, and upward facing keyhole aperture 118B smaller portions, structural elements which are well suited to support considerable weight. This embodiment may also be practiced with the use of pallet securing members 118 or cleats 126 in the place of right angle support member 140. This embodiment also obviates the need for the insertion or removal of pallet securing devices 124, speeding assembly and disassembly.

FIG. 9B is a top view of the embodiments shown in FIG. 9A.

Figure 10:
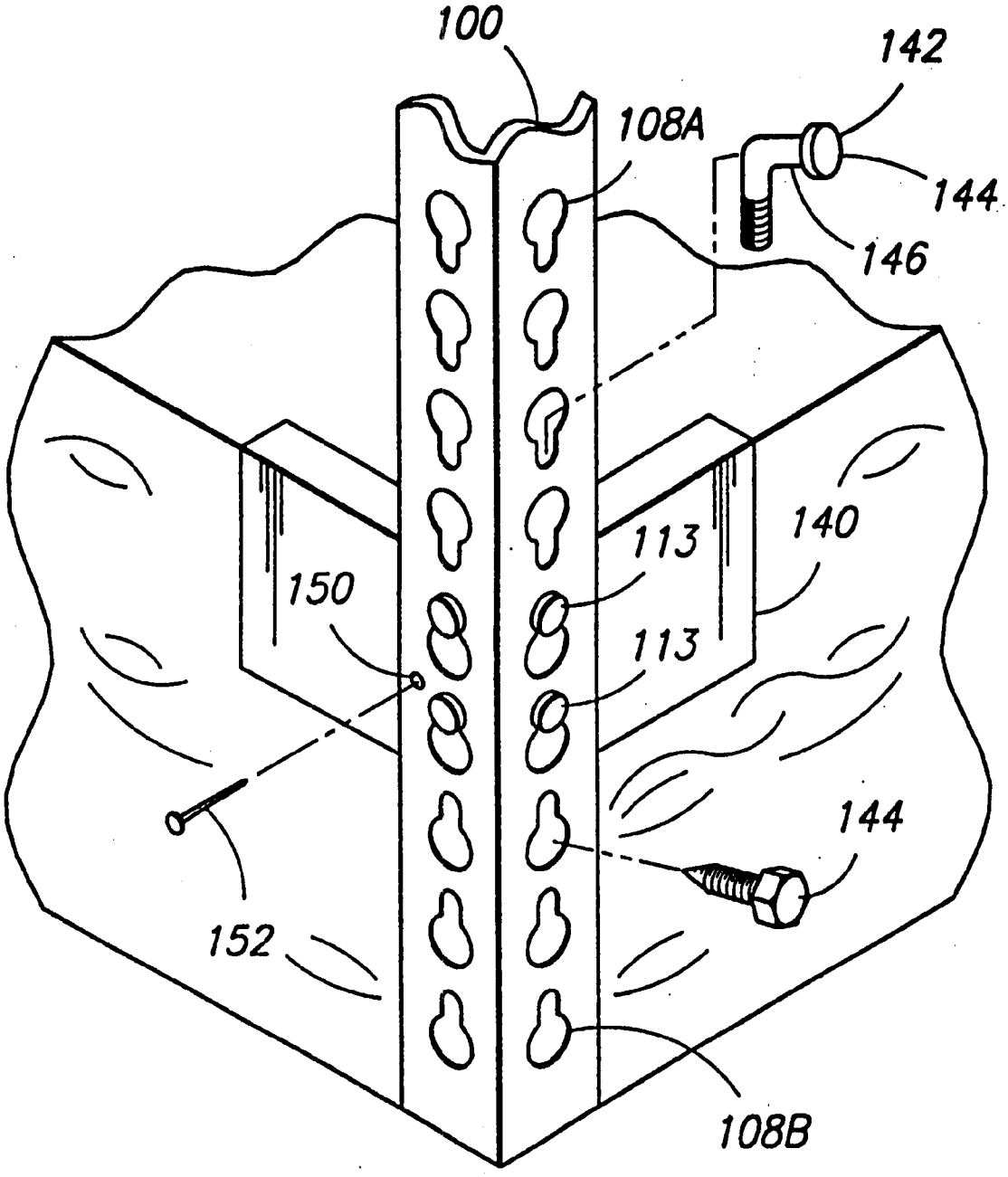
FIG. 10 is a perspective view of an embodiment using the inverted keyhole aperture configuration.

FIG. 10 shows a perspective view of the foregoing embodiment of the present invention. Safety devices, such as clips or right angle bolts 142 can be inserted into keyhole apertures 108. In the event of a tab 110 failure, these safety devices serve to restrict excessive motion of structures that were supported by the failed tab 110. In the illustrated embodiment, right angle bolt 142 is inserted into keyhole aperture 108A. The right angle bolt 142 comprises a head structure 144 which prevents passage through the keyhole aperture 108, and preferably, a shank structure 146 that is smaller in cross section than the smaller portion of the keyhole aperture 108. In one embodiment, shank structure 146 is of sufficient length and/or mass to assure that the right angle bolt 142 is balanced so as to remain in the keyhole aperture 108 after insertion. If necessary, the safety device may be locked or secured into the keyhole apertures by bolts, clips, pins, or other means.

Friction between the tabs 110 and the upward facing keyhole apertures 108B as well as friction between the right angle support members 140 and the vertical support members 100 are generally sufficient to retain the tabs 113 in the smaller portion of the keyhole aperture 108B. However, if desired, vertical support member 100 and right angle support member 140 may also comprise interconnecting fastening means. Such fastening means can feature, for example, one or more shear apertures 150 in each structure adjacently disposed on assembly, thus allowing the insertion of a pin, nail, or other device 152 after assembly to restrict the apertures from sliding relative to one another. Similarly, if desired, the right angle support member 140 and pallet 102 can be affirmatively secured to the vertical support member 100 by means of a wood screw, nail, bolt or other securing device 144 inserted through the upward facing keyhole aperture 108B larger portion.

Figure 11:
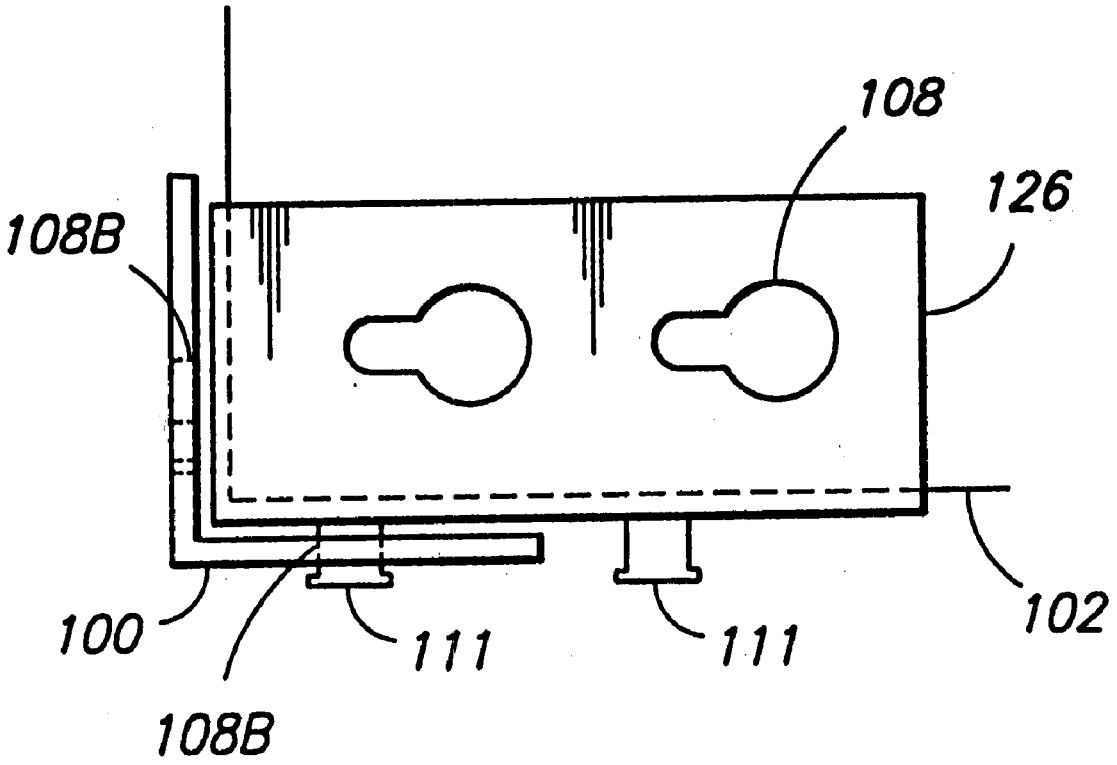
FIG. 11 is a top view of another embodiment of the present invention using the inverted keyhole apertures.

FIG. 11 is a diagram illustrating another embodiment of the present invention. In this embodiment, a simple cleat 126 is used in place of the right angle support member 126. If additional strength is desired, a second cleat can be disposed at a right angle to and lapped on top of the illustrated cleat so that the cleat tabs 111 from the second cleat are disposed through the upward facing keyhole apertures 108A in the vertical support member 100. If necessary, the location of the upward facing keyhole apertures 108A presented to the cleat tabs 111 of the second cleat can be adjusted vertically in an amount sufficient to account for the vertical displacement of the second cleat, or the location of the tabs on the second cleat can be so adjusted to achieve the same effect. Also, if desired, a nail, bolt, or wood screw may be inserted into the cleat 126 keyhole aperture 118 and into the pallet 102 to secure the pallet 102 to the assembly.

Upward facing keyhole apertures 108B are generally disposed near the lower portion of the vertical support members 100. However, that need not be the case. Upward facing keyhole apertures 108B can be disposed on any portion of the vertical support members 100, and when used in conjunction with other structures herein described, provide an exceptionally strong means for lifting and transporting any assembly constructed using the vertical support members 100.

Figure 12A:
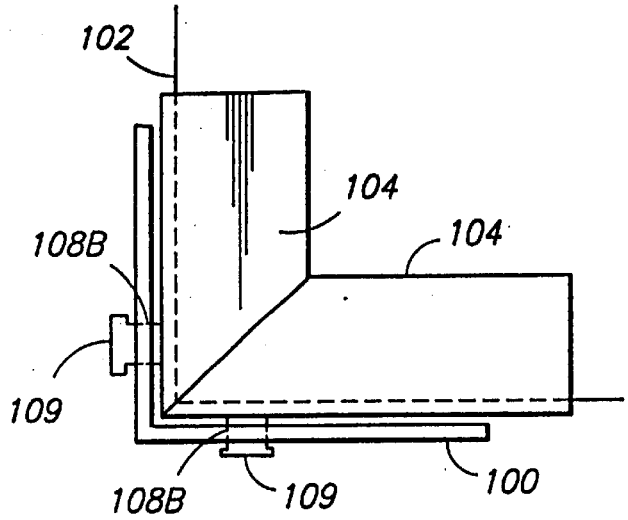
FIG. 12A is a top view of another embodiment of the present invention showing an alternative arrangement for the pallet securing members.
Figure 12B:
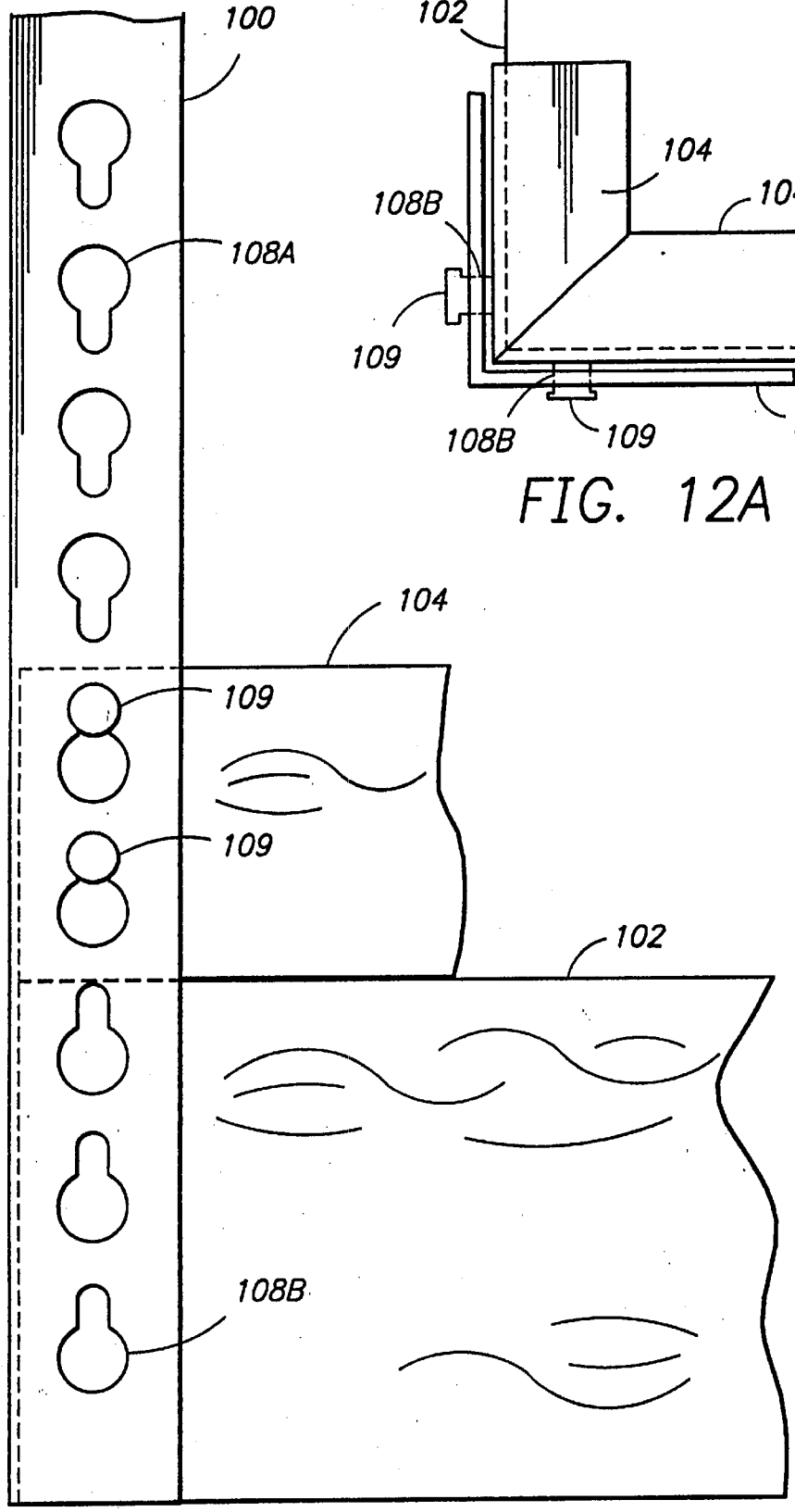
FIG. 12B is a side view of another embodiment of the present invention showing an alternative arrangement for the pallet securing members.

FIGS. 12A and 12B present another embodiment of the present invention, in which the pallet securing members (here, inverted cross braces 104) are affixed so that the securing surface is disposed at the bottom of the securing member. This configuration can be advantageously used to accommodate different pallet 102 thicknesses.

Figure 13:
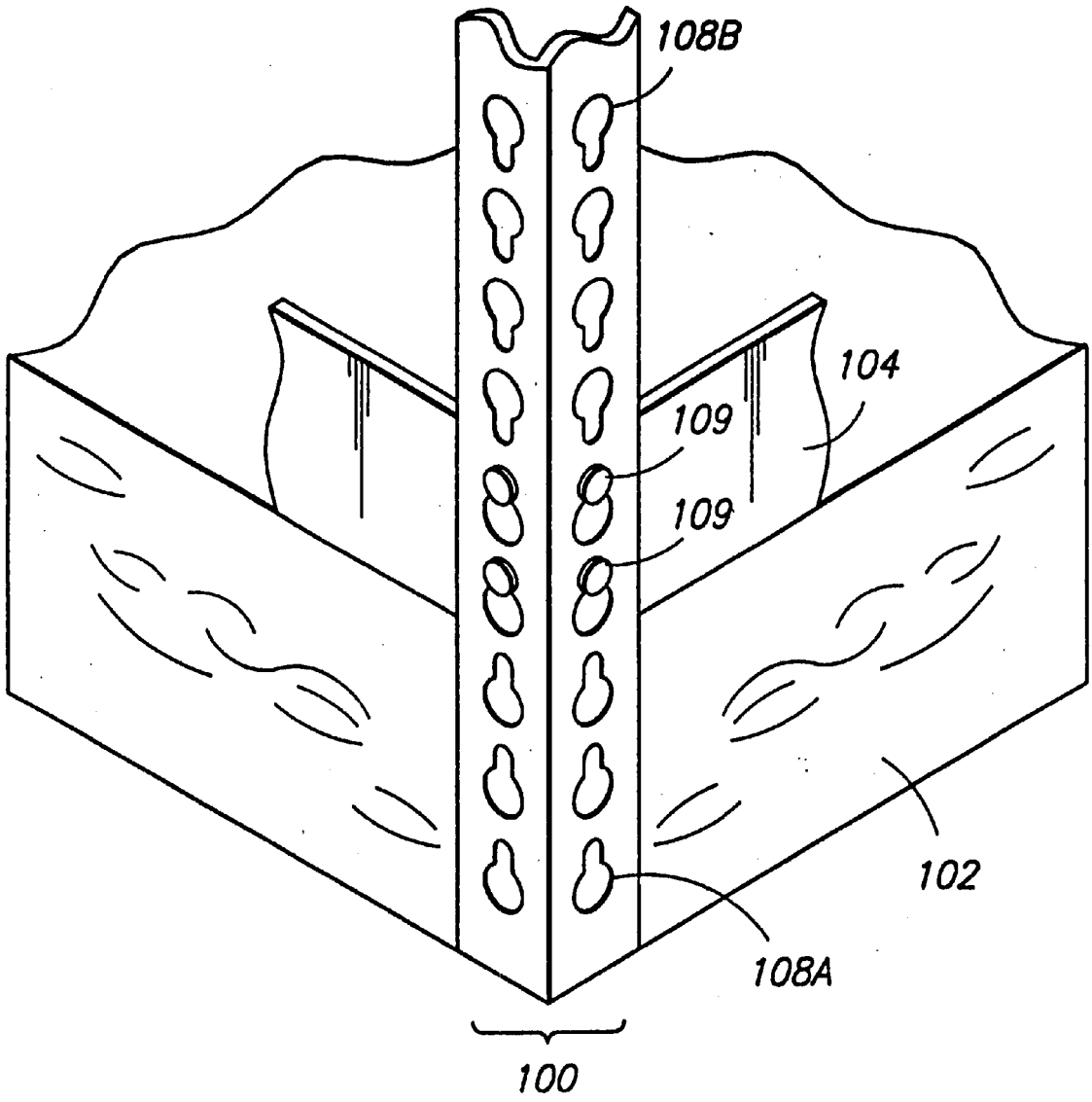
FIG. 13 is a perspective view of another embodiment of the present invention showing an alternative arrangement for the pallet securing members.

FIG. 13 is a perspective view of the alternative embodiment shown in FIGS. 12A and 12B.

Figure 14:
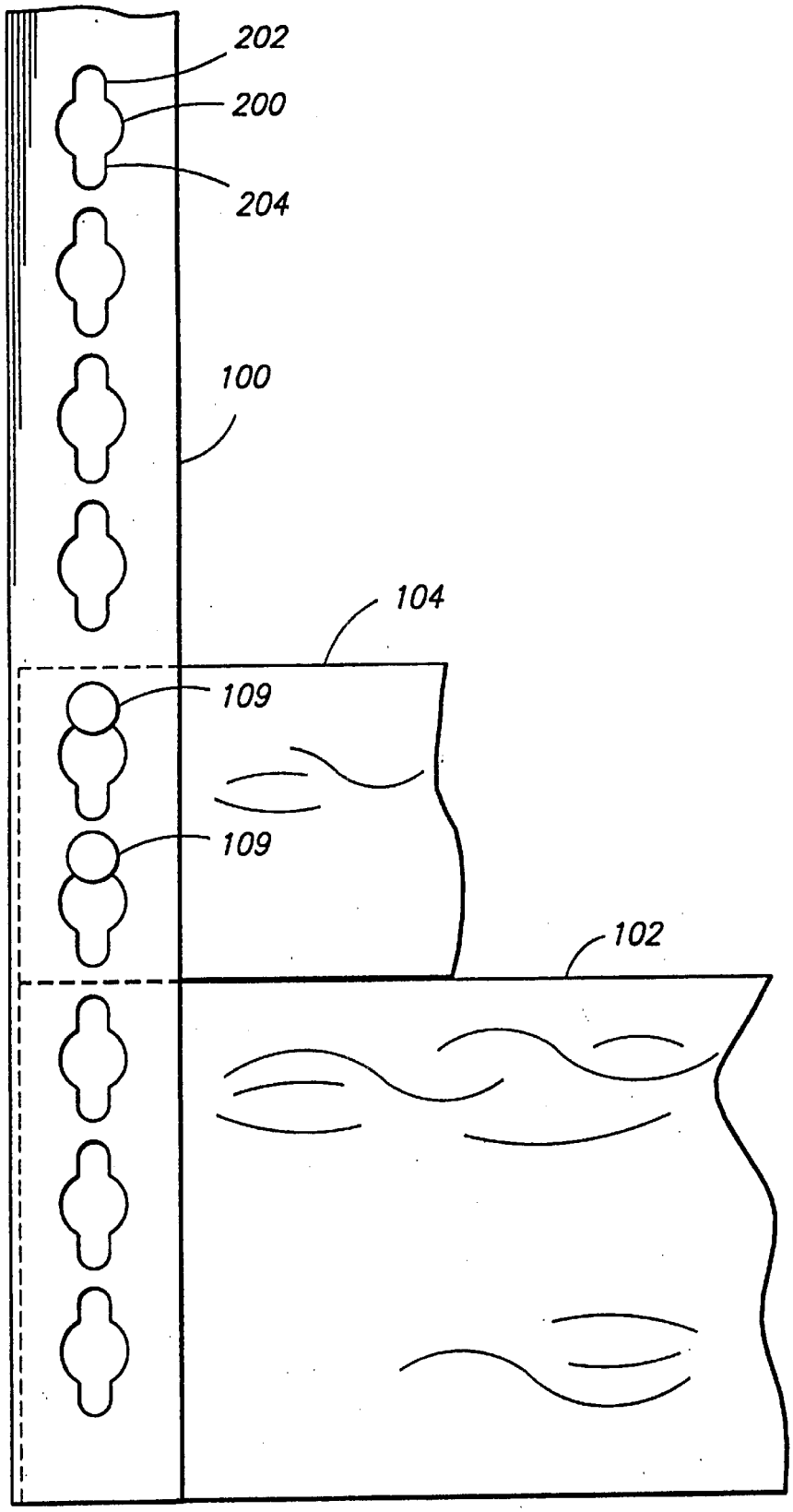
FIG. 14 is a side view of another embodiment of the present invention showing the use of double-sided keyhole apertures.

FIG. 14 is a side view of another embodiment of the present invention in which keyhole apertures are replaced with double-sided keyhole apertures 200. Each double-sided keyhole aperture 200 has an upward oriented aperture segment 202 and a downward oriented aperture segment 204. This design is simpler to produce because the keyhole apertures 200 have a symmetrical orientation and can be easily punched from the vertical support members 100 without reorientation.

Figure 15:
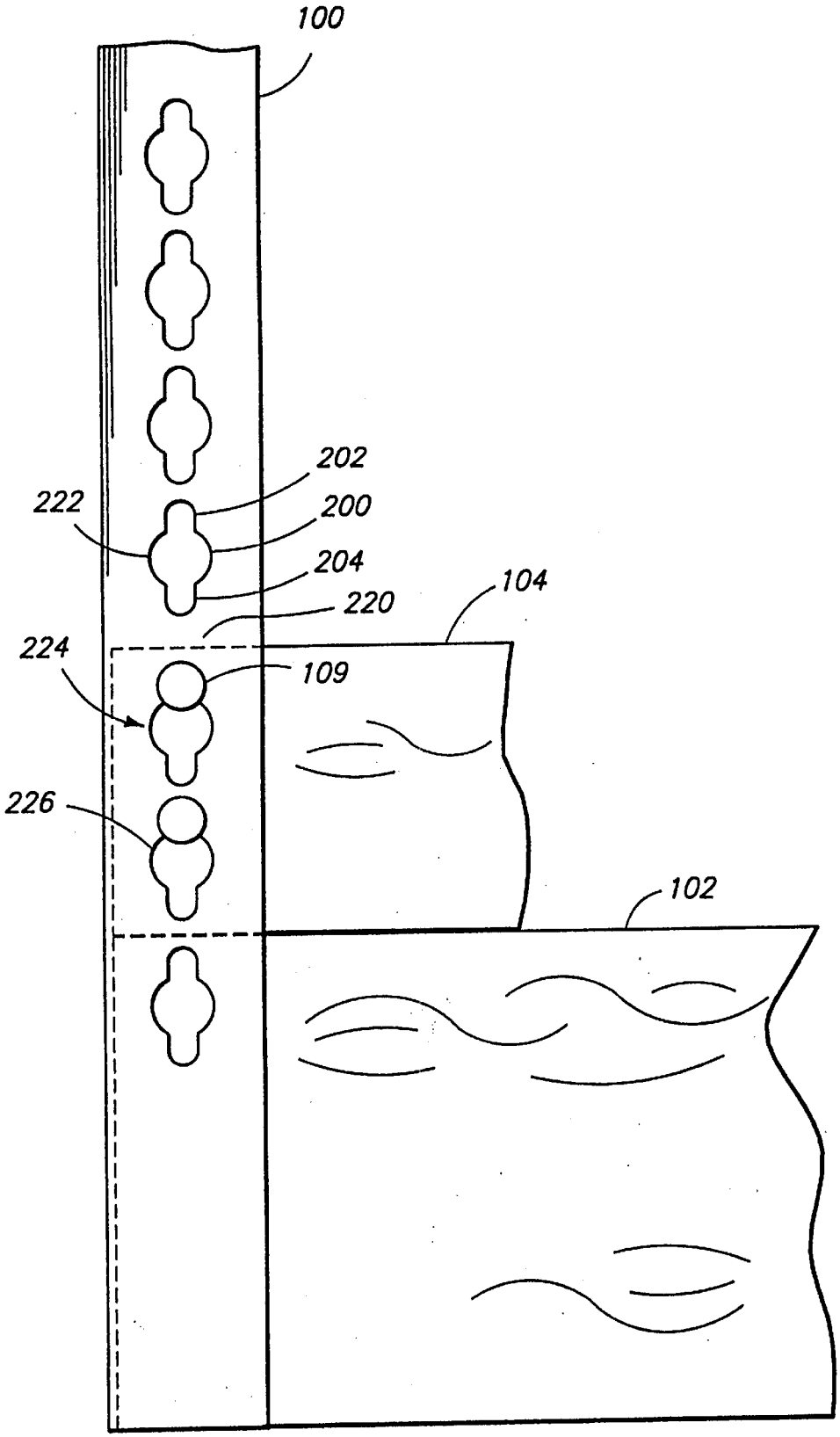
FIG. 15 is a side view of another embodiment of the present invention showing the use of a strengthening segment in the vertical support member.

FIG. 15 illustrates another embodiment of the present invention using double-sided keyhole apertures 200. In this embodiment, a strengthening segment 220 is placed between the double-sided keyhole apertures 200 to increase the strength of the modular shelving. This configuration is particularly well suited to heavy loads. Strengthening segment 220 can be implemented by a greater distance between double-sided keyhole apertures 222 and 224, a greater distance between the double-sided keyhole apertures 224 and 226, or a greater distance between both. Alternatively, a vertical support member can be reinforced in this area as required with additional thickness material, molding or stamping a stronger shape, or by heat treatment.

Figure 16:
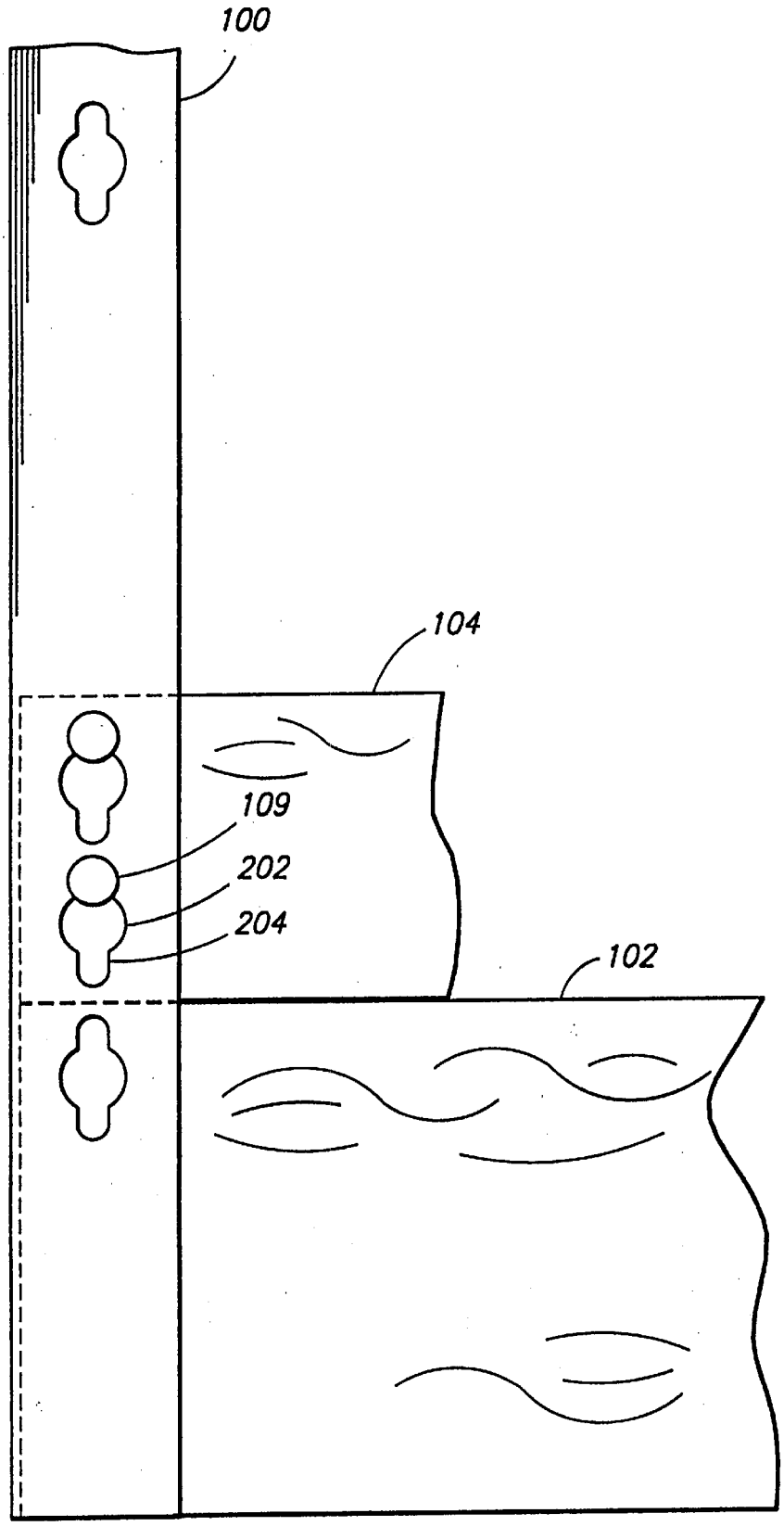
FIG. 16 is a side view of another embodiment of the present invention showing the use of fewer keyhole apertures.

FIG. 16 illustrates another embodiment of the present invention in which only a limited number of double-sided keyhole apertures 200 are utilized. This configuration is useful in situations where higher vertical support member 100 rigidity is required, or when less flexibility in shelf location is required.

In addition to the aforementioned advantages, the present invention is also easily constructed and broken down. Construction is accomplished by placing pallet securing members 118 or cleats 128 about the periphery of the pallet 102 so that the pallet securing tabs 110 (or, in embodiments using cleats 126, the cleat tabs 111) face outward from the center of the pallet. Next, vertical support members 100 are placed at each corner of the pallet 102. Then, downward force is applied to the vertical support members to lock them to the pallet securing members 118 (or cleats 126). Then, the desired number and location of shelves is determined. At the aforementioned locations, four cross braces 104 are inserted into the structure with the tabs 110 on the braces fitting into the keyhole apertures 108 in the vertical support members 100. Downward force is then applied to the cross braces 104, affixing them in position. When so inserted, these cross braces 104 form a shelf upon which the planar surface 106 is placed, completing the construction. Disassembly follows the reverse procedure.

Figure 17:
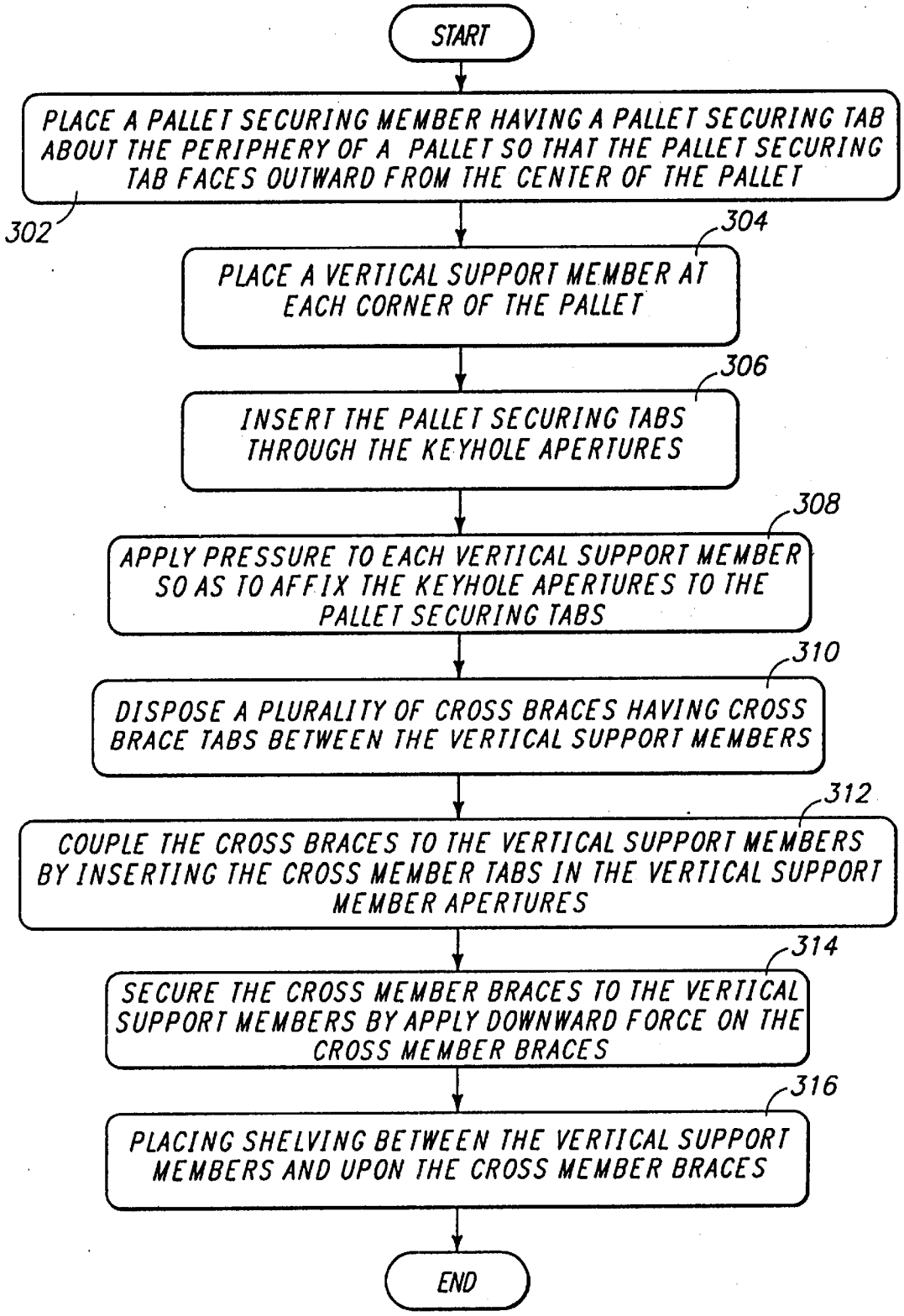
FIG. 17 is a flow chart depicting the assembly of one embodiment of the present invention.

FIG. 17 is a flowchart illustrating the foregoing operations. The process begins by placing 302 a pallet securing member 118 having a pallet securing tab 110 about the periphery of a pallet so that the pallet securing tab faces outward from the center of the pallet 102. Then, vertical support members 100 are placed 304 at each corner of the pallet 102, and the pallet securing tabs 110 are inserted 306 through the keyhole apertures 108. Pressure is then applied 308 to each vertical support member 100 so as to affix the keyhole apertures 108 to the pallet securing tabs 110. A plurality of cross braces 104 having cross brace tabs 109 are then disposed 310 between the vertical support members 100. These cross braces 104 are then coupled and secured to the vertical support members 100 by inserting the cross member tabs 109 in the vertical support member apertures 108 and applying suitable force on the cross member braces 104. Finally, the process is completed by placing 316 shelving between the vertical support members 100 and upon the cross member braces 104.

The present invention may be practiced in a number of embodiments. For example, while the foregoing has been described with respect to conventional L-shaped steel shelving with tabs 110 and keyhole shaped apertures 108, the present invention can be practiced with other means to affix the elements of the invention together. Similarly, although generally stronger in construction, L-shaped members are not required to practice the present invention. Although the present invention is especially suitable for transport via fork lifts, it is also envisioned that the foregoing invention can be practiced with the use of wheels (which may comprise braking or setting means) affixed to the bottom surface of the pallet 102. Also, while the present invention has been described with apertures 108 on the vertical support members 100, and tabs on other elements, the invention is not so limited, and could be practiced in other embodiments. For example, the present invention could be practiced using tabs on the vertical support members, and apertures on the other interconnecting elements. Cross braces can also be affixed with the use of push-through sections at appropriate locations in the vertical support members. Such push through sections can be fashioned by making U-shaped cuts in the vertical support members, and bending the cut sections inward. The upper portion of the cut sections can then support cross braces or shelving of medium to light weight.

Conclusion

In summary, a modular pallet and shelving assembly has been described which uses widely available conventional components, reduces damage to products in transit, and reduces time consuming handling of products to remove them from shipping containers and place them on retail shelves. The present invention presents a flexible solution to product transportation. The structure may be returned to the manufacturer, broken down and used for its component parts, or disposed of, or returned to the manufacturer in an assembled or disassembled state. Further, the present invention supports multiple pallet structures to heights suitable for retail display and merchandising.

The foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A shelf assembly, comprising:

a plurality of first support members;

a second support member, coupled to at least one of the plurality of first support members, the second support member having a pallet-facing surface configured to bear at least a portion of the weight of the shelf assembly when the shelf assembly is lifted by a pallet; and wherein each of the plurality of first support members are disposed about a periphery of the pallet.

2. The shelf assembly of claim 1, wherein each of the plurality of first support members are disposed at a corner of the pallet.

3. The shelf assembly of claim 1, wherein the second support member is coupled to the pallet.

4. The shelf assembly of claim 3, wherein at least one of the plurality of first support members includes an aperture.

5. The shelf assembly of claim 4, wherein the second support member is secured to the at least one of the plurality of first support members via insertion of a member through the aperture.

6. The shelf assembly of claim 5, wherein the member is a bolt.

7. The shelf assembly of claim 5, wherein the member is a pin.

8. The shelf assembly of claim 1, wherein the shelf assembly comprises a plurality of second support members, each disposed proximate a corner of the pallet.

9. The shelf assembly of claim 1, wherein the second support member is disposed proximate at least one side of the pallet.

10. The shelf assembly of claim 1, wherein the second support member is disposed about at least two sides of the pallet.

11. The shelf assembly of claim 1, wherein the shelf assembly comprises a plurality of second support members that collectively bear the weight of the shelf assembly when the shelf assembly is lifted by the pallet.

12. A shelf assembly, comprising:

a plurality of vertical support members, each of the plurality of vertical support members having a first pallet-facing surface;

at least one pallet support member, coupled to at least one of the vertical support members, the support member comprising a second pallet-facing surface; and wherein the plurality of first pallet-facing surfaces and the second pallet-facing surface are disposed about a periphery of a pallet to restrain the pallet therebetween from motion in a horizontal direction and a vertical direction.

13. The shelf assembly of claim 12, wherein the plurality of first pallet-facing surfaces and the second pallet-facing surface are disposed about the periphery of the pallet to restrain the pallet therebetween from motion in the horizontal direction and the vertical direction when the pallet is lifted in the vertical direction.

14. The shelf assembly of claim 13, wherein each of the plurality of vertical support members are disposed proximate a corner of the pallet.

15. The shelf assembly of claim 14, wherein the pallet support member is coupled to the pallet.

16. The shelf assembly of claim 15, wherein at least one of the plurality of vertical support members includes an aperture.

17. The shelf assembly of claim 16, wherein the pallet support member is secured to the vertical support members via insertion of a member through the aperture.

18. The shelf assembly of claim 15, wherein the member is a bolt.

19. The shelf assembly of claim 15, wherein the member is a pin.

20. The shelf assembly of claim 12, comprising a plurality of pallet support members, wherein each of the pallet support members are disposed at a corner of the pallet.

21. The shelf assembly of claim 12, comprising a plurality of pallet support members, wherein each of the pallet support members are disposed about at least two sides of the pallet.

22. The shelf assembly of claim 12, comprising a plurality of pallet support members, wherein each of the pallet support members are disposed about at least three sides of the pallet.

23. The shelf assembly of claim 12, wherein all of the plurality of vertical support member surfaces are in contact with the pallet.

24. The shelf assembly of claim 23, wherein the pallet support member surface is in contact with the pallet.

* * * * *